US006928949B1

(12) United States Patent
Simon

(10) Patent No.: US 6,928,949 B1
(45) Date of Patent: Aug. 16, 2005

(54) CANOE STABILIZER HAVING VERTICALLY ADJUSTABLE BUOYANCY

(76) Inventor: Gerald M. Simon, 4530 Esch La., Madison, WI (US) 53704

( * ) Notice: Subject to any disclaimer, the term of this patent is extended or adjusted under 35 U.S.C. 154(b) by 5 days.

(21) Appl. No.: 10/804,028

(22) Filed: Mar. 19, 2004

(51) Int. Cl.[7] ..... B63B 35/71
(52) U.S. Cl. ..... 114/347; 114/123; 114/360
(58) Field of Search ..... 114/347, 360, 123, 114/352, 292; 441/44, 45

(56) References Cited

U.S. PATENT DOCUMENTS 655,234 A * 8/1900 Howe et al. ..... 114/123
1,823,730 A * 9/1931 Dornier ..... 114/292
3,537,417 A 11/1970 Beckner
3,902,443 A * 9/1975 McDougall ..... 114/39.22
4,641,594 A * 2/1987 Birkett ..... 114/43
4,807,551 A 2/1989 Ace
4,838,196 A 6/1989 Ingram
4,862,818 A * 9/1989 Sullivan ..... 114/126
5,324,218 A 6/1994 Rijnders
6,050,210 A * 4/2000 Grzybowski ..... 114/123
6,305,306 B1 * 10/2001 Grzybowski ..... 114/123
6,659,032 B1 12/2003 Simon
6,860,216 B1 * 3/2005 Morriseau ..... 114/123

* cited by examiner

*Primary Examiner*—Sherman Basinger
(74) *Attorney, Agent, or Firm*—Donald R. Schoonover

(57) ABSTRACT

A stabilizer is releasably attached to a canoe-like boat and includes two floats that are located outside the periphery of the boat. The floats are attached to bars, and lock mechanisms attach the bars to the boat. The bars are releasably attached end-to-end. Each float includes a main float portion. Each float also includes an adjustable float portion and a strap that secures the adjustable float portion either vertically above or vertically below the corresponding main float portion.

8 Claims, 4 Drawing Sheets

CANOE STABILIZER HAVING VERTICALLY ADJUSTABLE BUOYANCY

BACKGROUND OF THE INVENTION

1. Field of the Invention

The present invention relates to the general art of water vehicles, and to the particular field of accessories for small water craft.

2. Discussion of the Related Art

Many people enjoy spending their leisure time in pursuit of outdoor recreational activities. These activities include athletics, hunting, fishing, camping, hiking and boating. Many people who participate in these activities do so infrequently. This group of people may or may not have all of the equipment or expertise that they need in order to fully and safely enjoy themselves. Other enthusiasts are found with a full complement of equipment and materials needed to safely derive the greatest amount of pleasure from participation in their chosen activity. This latter group generally has taken training classes or has been coached in the activity's finer traits.

Boating is a popular outdoor activity. By itself, boating can bring one into a close relationship with nature as a canoeist or kayaker glides nearly silently through a marsh or along a river. In combination with camping, hiking, hunting or fishing, the use of a boat can enhance outdoor experiences. The use of a boat requires that a person follow certain prescribed safety guidelines including the use of life jackets and following boat capacity limitations.

Paddling a canoe has its own set of usage guidelines as well as those that pertain to all types of boats. In particular, the style of some canoes makes them slightly unstable as compared to a rowboat or Jon boats or the like. This is especially true of canoes with narrow hulls such as those that might be used on a river rather than on a lake for example.

Therefore, it is not uncommon for even experienced canoeists to be involved in an accidental tipping of a canoe.

Therefore, there is a need for a stabilizer mechanism for use on a boat which will increase the safety of the boat for both experienced and inexperienced boaters.

Many canoes or the like are carried over great distances and are assembled only when used and then disassembled after use. This assembly and disassembly may take place under difficult conditions, such as may occur in the woods or the like. The more parts that must be assembled or disassembled, the greater the likelihood that the parts can become lost or will not be properly assembled. If there are too many parts, the canoeist may simply omit part of the boat. If a safety system falls into this category, the safety system may be omitted, and the safety features associated therewith will not be available if needed.

Therefore, there is a need for a safety mechanism for use on a boat which is easily assembled and disassembled.

Still further, if an added feature increases the cost of a boat, it may be omitted. As discussed above, if the added feature is a safety feature, there may be a temptation to omit the feature in an effort to save money. This may be especially tempting to an experienced canoeist. However, it is desirable to encourage everyone to take full advantage of any and all safety features that are available to a canoeist.

Therefore, there is a need for a stabilizer mechanism for use on a boat which is sturdy and reliable yet which is also inexpensive.

Since many canoeists travel on waters that can become rough at a moment's notice and without warning, it is especially desirable to have a safety feature that will prevent tipping of the boat. While an experienced canoeist may be able to right a boat under most conditions, an inexperienced canoeist may lose control of the boat and capsize. Again, while an experienced canoeist may be able to handle a capsized situation, an inexperienced canoeist may find himself or herself in trouble if the canoe capsizes. Even experienced canoeists may find themselves in trouble if a canoe capsizes under certain conditions.

Therefore, there is a specific need for a stabilizer mechanism for use on a boat which will prevent the boat from capsizing.

The amount of draft exhibited by a small boat or canoe is variable, depending upon the weight of the occupant or occupants of the small boat or canoe combined with the weight of gear and equipment being carried by the small boat or canoe. For lighter loads, a small boat or canoe will ride higher in the water whereas; for heavier loads, the same small boat or canoe will ride lower—sometimes substantially lower—in the water. As a result, a stabilizer for a small boat or canoe carrying a heavier load will not exhibit the same characteristics as when that small boat or canoe is carrying a lighter load.

Therefore, what is needed is a stabilizer for a small boat or canoe wherein the stabilizer is vertically adjustable to compensate for different load weights imposed on the small boat or canoe.

PRINCIPAL OBJECTS OF THE INVENTION

The principal objects and advantages of the present invention include: providing a stabilizer mechanism for use on a small boat or canoe; providing such a stabilizer mechanism for use on a small boat or canoe which increases safety of the sport of boating; providing such a stabilizer mechanism for use on a small boat or canoe which increases the safety of boating for both experienced and inexperienced boaters; providing such a stabilizer mechanism for use on a small boat or canoe which inhibits capsizing thereof; providing such a stabilizer mechanism for use on a small boat or canoe which is easily attachable thereto and which is also easily removable therefrom; providing such a stabilizer mechanism for use on a small boat or canoe which is sturdy yet is also inexpensive; providing such a stabilizer mechanism for use on a small boat or canoe which is vertically adjustable to compensate for different load weights being imposed thereon; and generally providing such a stabilizer mechanism for a small boat or canoe that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

SUMMARY OF THE INVENTION

These, and other, objects are achieved by a stabilizer for a small boat having a forward end, an aft end, first and second sides connecting the forward end to the aft end, a top rail extending along the first and second sides of the boat, and a transverse axis extending between the first and second sides of the boat wherein the stabilizer includes a boat stabilizer system having first and second stabilizer units, each stabilizer unit having a body with a distal end and a proximal end a float fixedly mounted on the distal end of the body wherein the float includes a main float portion, at least one adjustable float portion, and a strap with fastening means structured to secure the at least one adjustable float portion vertically relative to the main float portion; a lock unit on the body between the proximal and distal ends of the body, and a connecting joint structured to connect the proximal ends of the bodies of the first and second stabilizing units to each other. In use, the proximal ends of the bodies of the first and second stabilizer units are connected together at the connecting joint and are located inside the boat, the stabilizer system extends across the boat in the direction of the transverse axis of the boat and the distal ends of the bodies of the first and second stabilizer units are located outside the boat, and the lock units of the first and second stabilizer units releasably engage the top rail of a respective side of the boat. Each main float portion of the first and second stabilizer units includes an upper surface having an upper profile, and a lower surface having a lower profile that is identical to the upper profile; and each adjustable float portion of the at least one adjustable float portion of the first and second stabilizer units includes an upper surface having a first auxiliary profile, and a lower surface having a second auxiliary profile that is identical to the upper profile of the main float portion. Each strap of the first and second stabilizer units includes at least one orifice for receiving the distal end of the respective body therethrough, the at least one orifice being spaced such that the fastening means of the strap is located above the respective float as the strap secures the at least one adjustable float portion vertically relative to the main float portion.

The floats on the distal ends of the mechanism tend to keep the boat from capsizing by engaging the water before the boat capsizes. The mechanism is easily set up and attached to the boat at any desired location on the boat, and is also easily disassembled. Once disassembled, the mechanism can be easily and conveniently stored. The stabilizer mechanism is relatively inexpensive to produce and maintain and/or replace as it is formed of sturdy, yet inexpensive elements. Thus, the stabilizer mechanism will be readily available to anyone who wishes to use such a mechanism.

BRIEF DESCRIPTION OF THE DRAWING FIGURES

DETAILED DESCRIPTION OF THE PREFERRED EMBODIMENT

Figure 1:
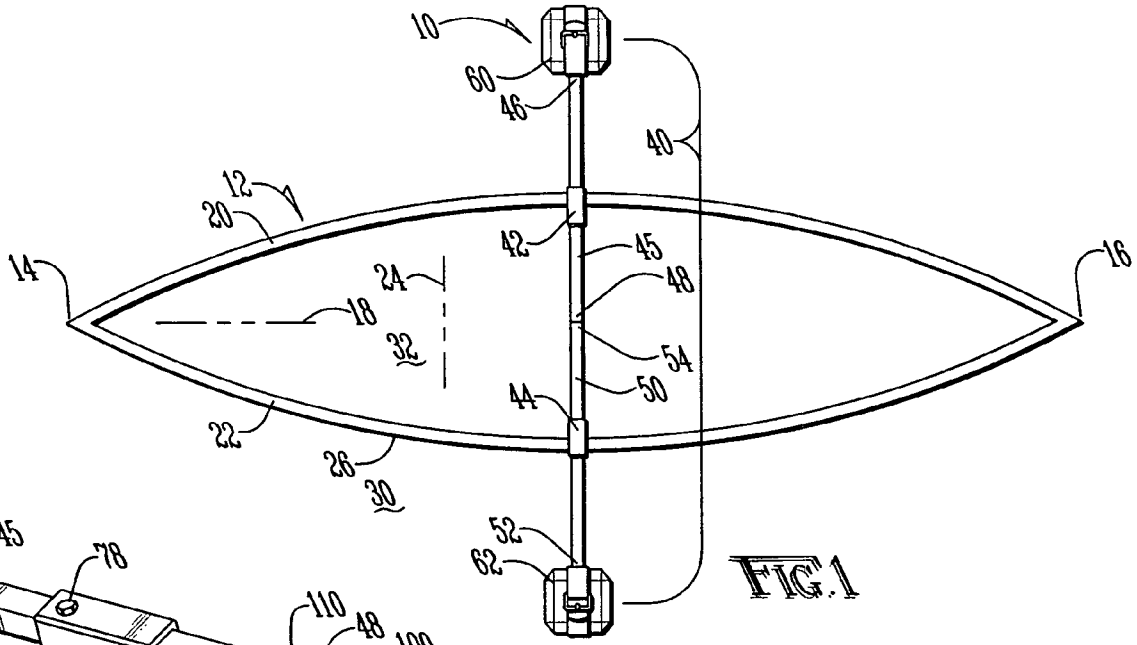
FIG. 1 is a top plan view of a canoe-like boat with the stabilizer mechanism of the present invention attached thereto.

Other objects, features and advantages of the invention will become apparent from a consideration of the following detailed description and the accompanying drawings.

As shown in the Figures, the present invention is embodied in a stabilizer 10 for a small or canoe-like boat 12. The stabilizer 10 prevents the boat 12 from capsizing by lowering the center of gravity of the boat 12 in the manner of a tightrope walker carrying a balance beam and also further engages the water on the lowered or lowering side of the boat 12 during a tipping motion, once that motion begins, to prevent the boat 12 from capsizing. Stabilizer 10 is used on the boat 12 which has a forward end 14, an aft end 16, and a longitudinal axis 18 extending between the forward end 14 and the aft end 16 of the boat 12. A first side 20 connects the forward end 14 to the aft end 16, a second side 22 connects the forward end 14 to the aft end 16, and a transverse axis 24 extends between the first side 20 and the second side 22. A periphery 26 is defined by the first side 20 of the boat 12, the second side 22 of the boat 12, the forward end 14 of the boat 12, and the aft end 16 of the boat 12. A top rail 28 extends along the periphery 26 of the boat 12, and defines an outside location 30 located outside the periphery 26 of the boat 12 and an inside location 32 located inside the periphery 26 of the boat 12.

Figure 2:
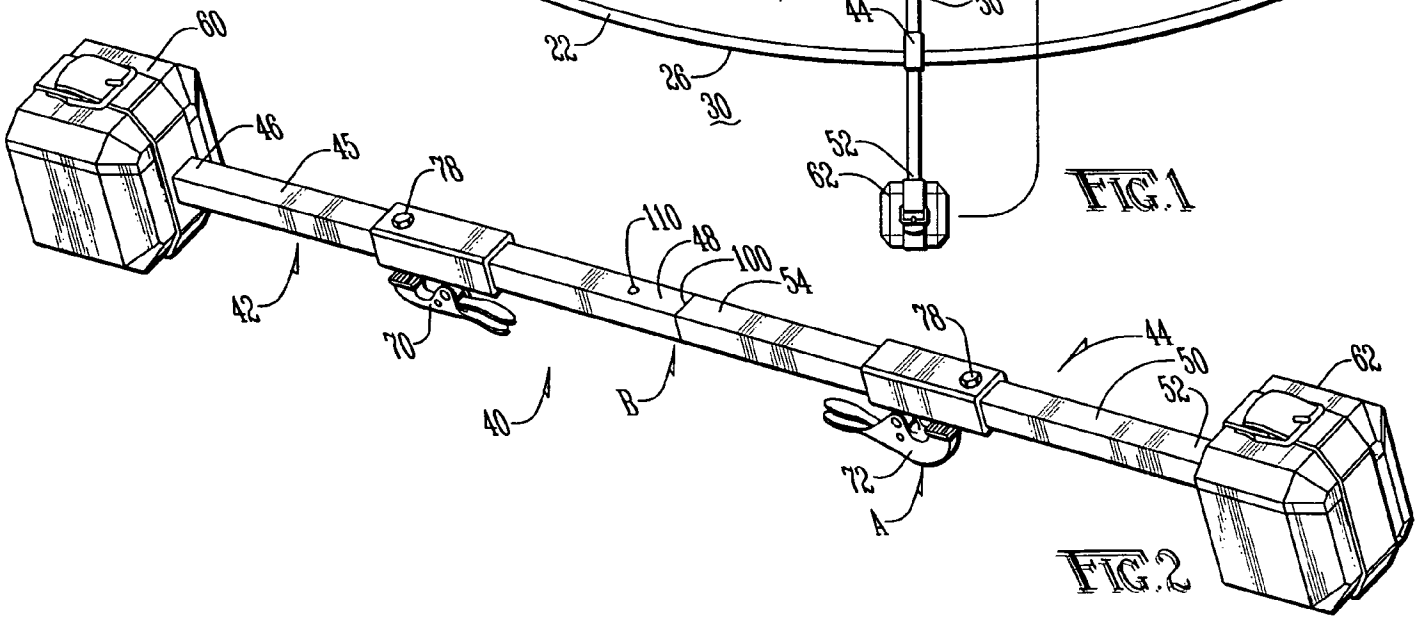
FIG. 2 is a perspective view of the stabilizer mechanism embodying the present invention.

A boat stabilizer system 40 includes a first stabilizer unit 42 and a second stabilizer unit 44. As shown in FIG. 2, the first stabilizer unit 42 has a body 45 with a distal end 46 and a proximal end 48. The distal end 46 of the body 45 of the first stabilizer unit 42 is located outside the periphery 26 of the boat 12 when the first stabilizer unit 42 is in use, and the proximal end 48 of the body 45 of the first stabilizer unit 42 is located inside the periphery 26 of the boat 12 when the first stabilizer unit 42 is in use.

Second stabilizer unit 44 has a body 50 with a distal end 52 and a proximal end 54. Distal end 52 of the body 50 of the second stabilizer unit 44 is located outside the periphery 26 of the boat 12 when the second stabilizer unit 44 is in use, and proximal end 54 of the body 50 of the second unit 44 is located inside the periphery 26 of the boat 12 when the second stabilizer unit 44 is in use. As shown, the proximal end 48 of the body 45 of the first stabilizer unit 42 is located adjacent to the proximal end 54 of the body 50 of the second stabilizer unit 44 when the first and second stabilizer units 42, 44 are in use.

A first float 60 is fixedly mounted on distal end 46 of the body 45 of the first stabilizer unit 42 and a second float 62 is fixedly mounted on distal end 52 of the body 50 of the second stabilizer unit 44. Floats 60 and 62 can be formed of styrofoam-like material or the like, or any suitable material that is highly buoyant.

The stabilizing system 40 of the present invention is releasably attached to the boat 12 so it can be easily assembled and set up and easily disassembled. To this end, a first lock unit 70 is mounted on body 45 of the first stabilizer unit 42 between distal end 46 and proximal end 48 of the body 45 of the first stabilizer unit 42, and a second lock unit 72 is mounted on the body 50 of the second stabilizer unit 44 between distal end 52 and proximal end 54 of the body 50 of the second stabilizer unit 44. The lock units 70, 72 can be any suitable form, such as the form shown in FIGS. 2 and 4, for example.

Each lock unit of the first lock unit 70 and the second lock unit 72 includes a sleeve 76 on the body 45, 50 of the stabilizer unit 42, 44 associated therewith; a fastener 78 attaching the sleeve 76 to the body 45, 50 of the stabilizer unit 42, 44 associated therewith; a mounting element 80 attached to sleeve 76; and a clamp element 82 attached to the mounting element 80.

Figure 4:
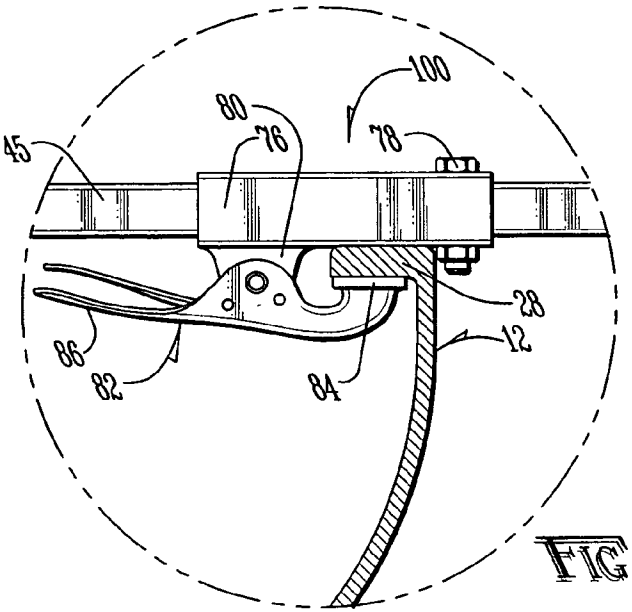
FIG. 4 is a detailed view of Detail A of FIG. 2.

As shown in FIGS. 2 and 4, each clamp element 82 of first and second lock units 70, 72 has a distal end 84 and a proximal end 86. The distal end 84 of each clamp element 82 engages the top rail 28 of the boat 12 when the stabilizer unit 42, 44 associated therewith is in use. Each clamp element 82 is movably attached to the mounting element 80 to move between a clamping position, shown in FIG. 4, wherein the distal end 84 engages the top rail 28, and a released position wherein the distal end 84 is spaced apart from the top rail 28.

Figure 3:
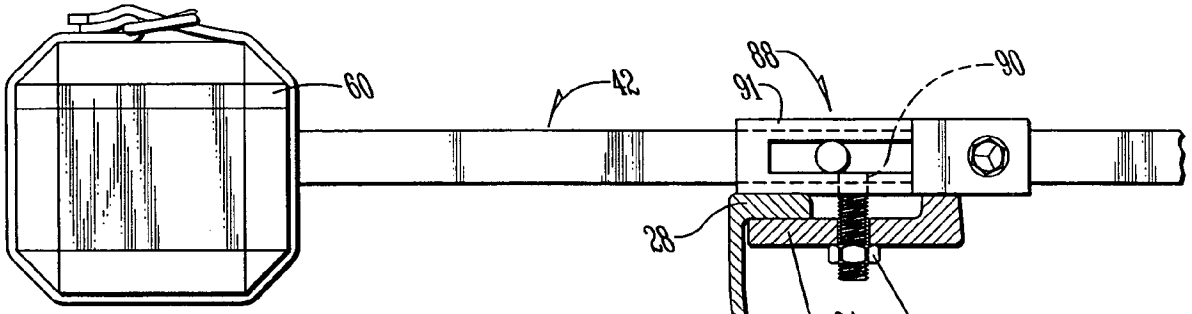
FIG. 3 is an elevational view of one unit of the stabilizer mechanism embodying the present invention in place on a canoe-like boat.

An alternative form 88 for the first and second lock units is shown in FIG. 3. The over-center clamp-type lock 88 is known in the art and, therefore, will not be discussed in detail other than to describe that the clamp-type lock 88 includes a threaded bore 90 defined in sleeve 91 as well as a threaded fastener 92 mounted on a clamp plate 94. Threaded movement of fastener 92 draws the clamp plate 94 toward the top rail 28 of the boat 12 to fix the stabilizer unit 42, 44 to the boat 12, while retrograde movement of the threaded fastener 92 will release the clamp plate 94 from the top rail 28 of the boat 12. It is to be understood that any other suitable forms may be utilized for the first and second lock units of the present invention, which is not intended to be limited to the two forms described and shown herein.

Figure 5:
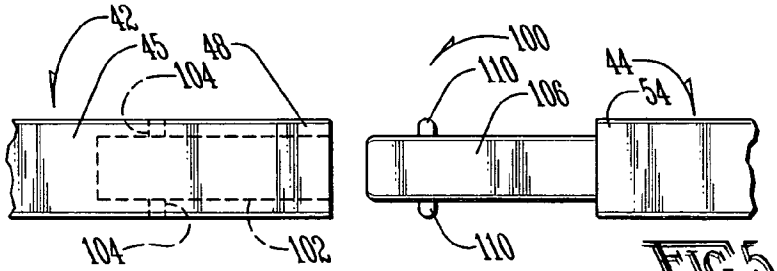
FIG. 5 is a detailed view of Detail B of FIG. 2.

The stabilizer units 42, 44 are easily assembled and disassembled and once assembled are very secure. A connecting joint 100 effects this assembly and disassembly. Connecting joint 100 is shown in FIGS. 2 and 5 and includes a cavity 102 defined in body 45 of the first stabilizer unit 42. Cavity 102 extends from proximal end 48 of the body 45 of the first stabilizer unit 42 toward the distal end 46 of the body 45 of the first stabilizer unit 42. A pair of locking holes 104 are defined through the body 45 of the first stabilizer unit 42 adjacent to cavity 102. A projection 106 extends longitudinally outwardly from the proximal end 54 of the body 50 of the second stabilizer unit 44. Projection 106 is sized to be releasably accommodated in cavity 102 defined in the body 45 of the first stabilizer unit 42. A pair of spring-biased locking pins 110 are located on projection 106 of the connecting joint 100. The pair of spring-biased locking pins 110, as indicated in FIG. 5, are located to be accommodated in locking holes 104 defined through the body 45 of the first stabilizer unit 42 when the projection 106 on the second stabilizer unit 44 is received in the cavity 102 of the first stabilizer unit 42. The diameter of the spring-biased locking pins 110 is smaller than the diameter of the pair of locking holes 104, and the pins 110 are biased to be seated in the pair of locking holes 104 when the projection 106 of the connecting joint 100 is received in the cavity 102 of the connecting joint 100.

Figure 6:
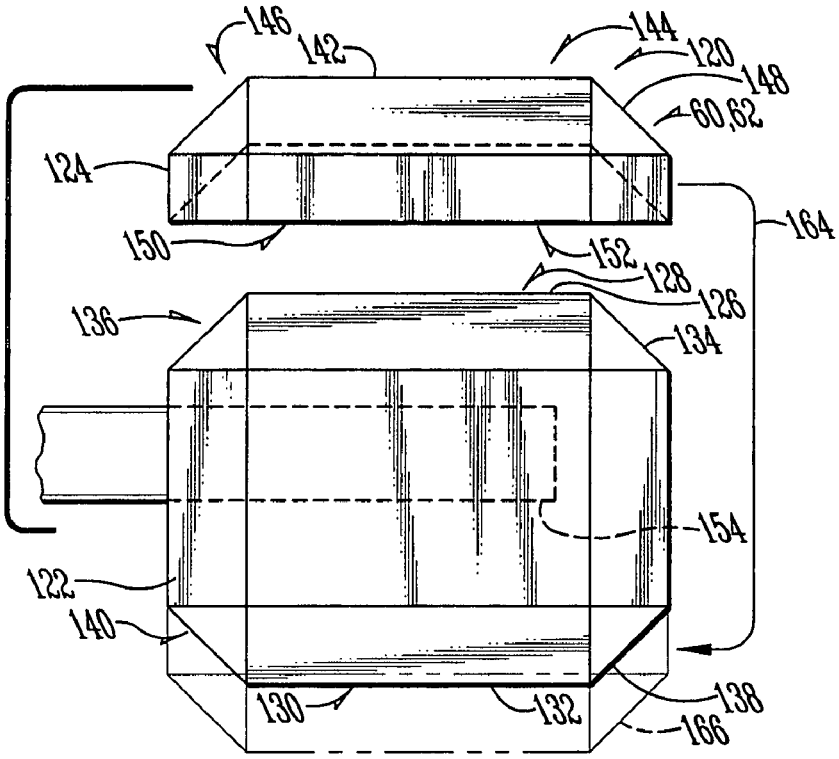
FIG. 6 is an enlarged and fragmentary, exploded view of a float of the present invention, showing a main float portion and an adjustable portion thereof without a securing strap.
Figure 7:
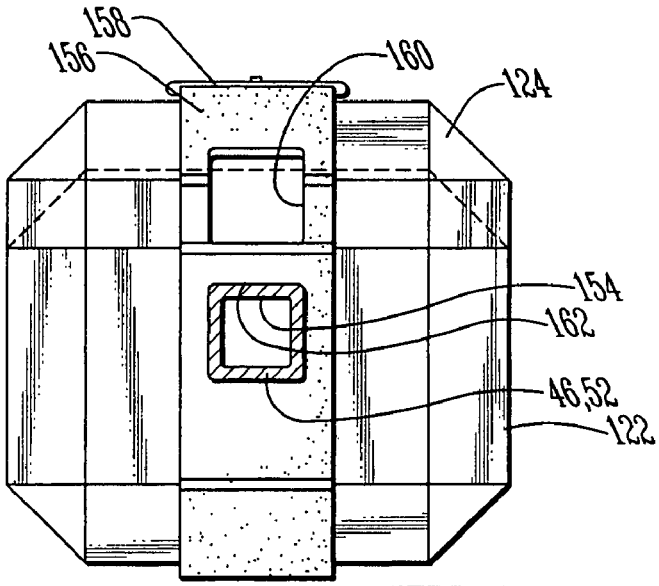
FIG. 7 is an enlarged and fragmentary, end elevational view of one of the floats of the present invention, showing the strap and orifices thereof.
Figure 8:
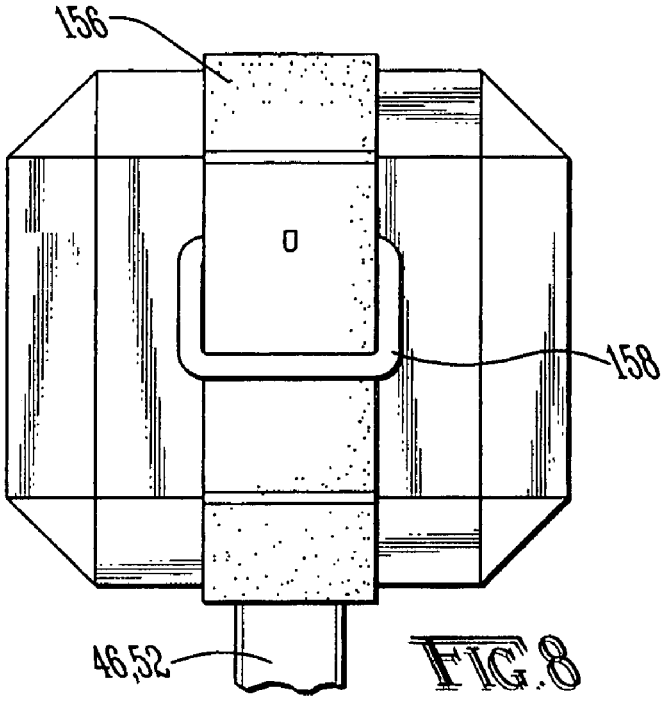
FIG. 8 is an enlarged and fragmentary, top plan view of one of the floats of the present invention, showing the strap and buckle thereof.

A structure 120 of the first and second floats 60, 62 that enables vertical adjustability of the buoyancy provided by the stabilizer of the present invention is shown in FIGS. 6 through 8. Each of the first and second floats 60, 62 includes a main float portion 122 and an adjustable float portion 124.

Each main float portion 122 has an upper surface 126 having an upper profile 128 that is identical to a lower profile 130 of a lower surface 132 of the main float portion 122 as hereinafter described. For example, an upper bevel 134 is formed along a perimeter 136 of the upper surface 126 of the main float portion 122, and a lower bevel 138 is formed along a perimeter 140 of the lower surface 132 of the main float portion 122. A horizontal cross-section of the main float portion 122 is generally square- or rectangular-shaped. It is to be understood, however, that floats 60, 62 of the present invention may have any suitable configuration as desired.

Each adjustable float portion 124 has an upper surface 142 having a first auxiliary profile 144 that is preferably identical to the profile 128 of the upper surface 126 and profile 130 of lower surface 132 of the main float portion 122. The horizontal cross-section of the adjustable float portion 124 is identical to the horizontal cross-section of the main float portion 122. An upper bevel 146 is formed along a perimeter 148 of the upper surface 142 of the adjustable float portion 124. A lower surface 150 of the adjustable float portion 124 is configured to have a second auxiliary profile 152 that is the inverse of the upper profile 128 of the upper surface 126 and the lower profile 130 of the lower surface 132 of the main float portion 122 such that the entire second auxiliary profile 152 of lower surface 150 of the adjustable float portion 124 can be placed either in abutting engagement with the entire upper profile 128 of the upper surface 126 of the main float portion 122, or in abutting engagement with the entire lower profile 130 of the lower surface 132 of the main float portion 122.

Figure 9:
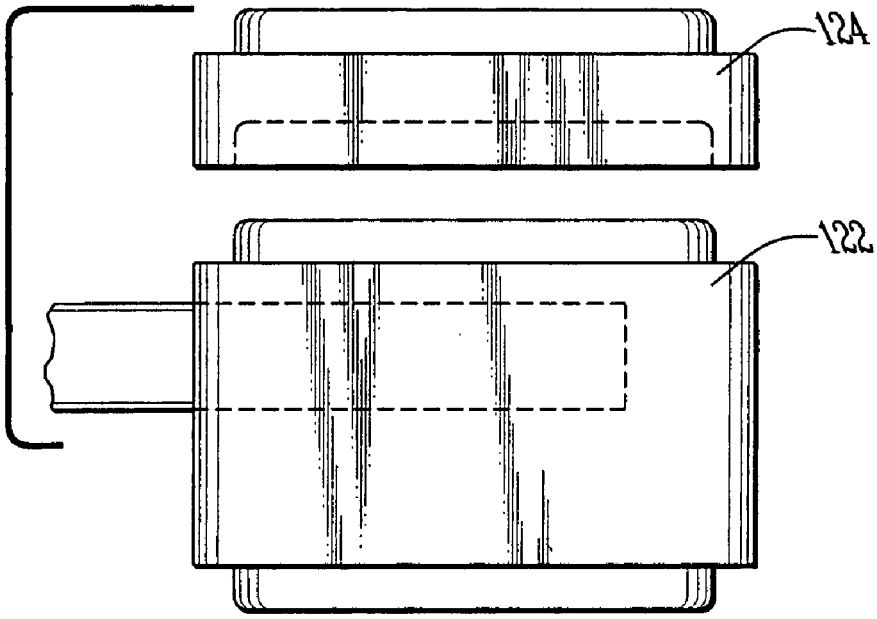
FIG. 9 are alternative, compatible upper, lower and auxiliary profiles for the main float portion and the adjustable float portion of the canoe stabilizer having vertically adjustable buoyancy, according to the present invention.

It is to be understood that other upper, lower and auxiliary profiles, such as those shown in FIG. 9, or any other suitable profiles that are compatible with each other as described herein, may be used in lieu of those shown and described.

A cavity 154 is formed in each of the main float portions 122 to receive the distal end 46, 52 of the respective stabilizer unit 42, 44 as shown in FIGS. 6 and 7.

A flexible belt or strap 156 is structured and configured to encircle each of the floats 60, 62, as shown in FIGS. 7 and 8, such that the main float portion 122 and the adjustable float portion 124 thereof are securely constrained to a vertical spacing relative to each other. Each strap 156 is constructed of a non-stretchable, water-resistant material such as plastic, canvas, or other suitable material and includes fastening means, such as a buckle 158, hook-and-loop fastening material, or other suitable means. Each strap 156 also includes an appropriately spaced upper orifice 160 and an appropriately spaced lower orifice 162, as shown in FIG. 7, to receive the respective distal end 46, 52 therethrough as described hereinbelow. For uses wherein a boat is heavily loaded and is riding lower in the water, each of the adjustable float portions 124 are positioned above the respective main float portion 122 as shown in FIGS. 6 and 7. In that event, distal ends 46, 52 are passed through lower orifice 162, wherein lower orifice 162 is spaced such that the buckle 158 is positioned on the upper surface 142 of the respective adjustable float portion 124 when the respective strap 156 is secured around the respective float 60, 62, as shown in FIGS. 7 and 8.

If the boat is used with less weight such that the boat is riding higher in the water whereat the floats 60, 62 may only minimally contact the water or be positioned entirely above the water, the end of each strap 156 is removed from the respective buckle 158 and the respective main float portion 122 and strap 156 are removed from the respective distal end 46, 52. The distal end 46, 52 is then inserted through upper orifice 160 and reinserted into the respective main float portion 122. In addition, the adjustable float portion 124 is removed from the upper surface 126 of the main float portion 122, flipped over, and re-positioned such that second auxiliary profile 150 of the adjustable float portion 124 is placed in abutting engagement with lower profile 130 of the main float portion 122 as indicated by the arrow designated by numeral 164 and as shown in dotted lines designated by numeral 166 in FIG. 6. The respective buckle 158 is then used to securely constrain the adjustable float portion 124 to be vertical spaced below the main float portion 122. As with the lower orifice 162, the upper orifice 160 is spaced such that the buckle 158 is spaced above the upper surface 126 of the main float portion 122 when the strap 156 is secured about the respective float 60, 62 with the main float portion 122 positioned above the adjustable float portion 124.

For some applications, it may be desirable that cavity 154 extends completely through main float portion 122. In that event, one or more additional appropriately spaced orifices through the straps 156 may be needed. It is to be understood that for some applications, it may be desirable to use more than one adjustable float portion in conjunction with each main float portion. In that event, the stabilizing system of the present invention would be enabled to provide additional vertically adjustable buoyancy characteristics as hereinbefore described.

As shown in FIG. 1, when the stabilizer system embodying the present invention is in use, the stabilizer system extends across the boat 12 in the direction of the transverse axis 24 of the boat 12, the lock unit 70 of the first stabilizer unit 42 releasably engages the top rail 28 on the first side 20 of the boat 12, the lock unit 72 of the second stabilizer unit 44 releasably engages the top rail 28 on the second side 22 of the boat 12, the projection 106 of the connecting joint 100 is received in the cavity 102 of the connecting joint 100, the float 60 on the first stabilizer unit 42 is located outside the periphery 26 on the first side 20 of the boat 12, and the float 62 on the second stabilizer unit 44 is located outside the periphery 26 on the second side 22 of the boat 12. The user, sits inside the boat 12 and the stabilizer system 40 of the present invention prevents the boat 12 from capsizing as discussed above. Depending on the draft of the boat due to its total passenger and cargo weight, the buoyancy provided by the stabilizer of the present invention may need to be vertically adjusted before embarking. If the floats of the stabilizer ride too low or too high relative to the water, less than optimal stability may be realized from the stabilizer.

It is to be understood that while certain forms of the present invention have been illustrated and described herein, the present invention is not to be limited to the specific forms or arrangements of parts described and shown.

What is claimed is:

1. A combination boat and stabilizer comprising:

(a) a small boat having a forward end, an aft end, first and second sides connecting the forward end to the aft end, a top rail extending along the first and second sides of the boat, and a transverse axis extending between the first and second sides of the boat; and (b) a boat stabilizer system which includes first and second stabilizer units, each stabilizer unit including:

(1) a body with a distal end and a proximal end, (2) a float fixedly mounted on the distal end of the body wherein the float includes a main float portion, at least one adjustable float portion, and a strap with fastening means structured to secure the at least one adjustable float portion vertically relative to the main float portion, (3) a lock unit on the body between the proximal and distal ends of the body, the lock unit including an over-center clamping means, and (4) a connecting joint structured to connect the proximal ends of the bodies of the first and second stabilizing units to each other; and (c) wherein each strap of the first and second stabilizer units includes an orifice for receiving the distal end of the respective body therethrough, the orifice being spaced such that the fastening means of the strap is located above the respective float as the strap secures the at least one adjustable float portion vertically relative to the main float portion; and (d) wherein, in use:

(1) the proximal ends of the bodies of the first and second stabilizer units are connected together at the connecting joint and are located inside the boat, (2) the stabilizer system extends across the boat in the direction of the transverse axis of the boat and the distal ends of the bodies of the first and second stabilizer units are located outside the boat, and (3) the lock units of the first and second stabilizer units releasably engage the top rail of a respective side of the boat.

2. The combination as described in claim 1, wherein:

(a) each main float portion of the first and second stabilizer units includes:

(1) an upper surface having an upper profile, and (2) a lower surface having a lower profile that is identical to the upper profile; and (b) each adjustable float portion of the at least one adjustable float portion of the first and second stabilizer units includes:

(1) an upper surface having a first auxiliary profile, and (2) a lower surface having a second auxiliary profile that is identical to the upper profile of the main float portion.

3. The combination as described in claim 1, wherein each strap of the first and second stabilizer units includes:

(a) a first orifice for receiving the distal end of the respective body therethrough, the first orifice being spaced such that the fastening means of the strap is located above the respective float as the strap secures the at least one adjustable float portion vertically above the main float portion; and (b) a second orifice for receiving the distal end of the respective body therethrough, the second orifice being spaced such that the fastening means of the strap is located above the respective float as the strap secures the at least one adjustable float portion vertically below the main float portion.

4. The combination as described in claim 1 wherein each lock unit includes a threaded bore defined in a sleeve attached to the respective body and a threaded fastener threadably received in the threaded bore.

5. A stabilizer for a small boat having a forward end, an aft end, first and second sides connecting the forward end to the aft end, a top rail extending along the first and second sides of the boat, and a transverse axis extending between the first and second sides of the boat, the stabilizer comprising:

(a) a boat stabilizer system which includes first and second stabilizer units, each stabilizer unit including:

(1) a body with a distal end and a proximal end, (2) a float fixedly mounted on the distal end of the body wherein the float includes a main float portion, at least one adjustable float portion, and a strap with fastening means structured to secure the at least one adjustable float portion vertically relative to the main float portion, (3) a lock unit on the body between the proximal and distal ends of the body, the lock unit including an over-center clamping means, and (4) a connecting joint structured to connect the proximal ends of the bodies of the first and second stabilizing units to each other; and (b) wherein each strap of the first and second stabilizer units includes an orifice for receiving the distal end of the respective body therethrough, the orifice being spaced such that the fastening means of the strap is located above the respective float as the strap secures the at least one adjustable float portion vertically relative to the main float portion; and (c) wherein, in use:

(1) the proximal ends of the bodies of the first and second stabilizer units are connected together at the connecting joint and are located inside the boat, (2) the stabilizer system extends across the boat in the direction of the transverse axis of the boat and the distal ends of the bodies of the first and second stabilizer units are located outside the boat, and (3) the lock units of the first and second stabilizer units releasably engage the top rail of a respective side of the boat.

6. The stabilizer as described in claim 5, wherein:

(a) each main float portion of the first and second stabilizer units includes:

(1) an upper surface having an upper profile, and (2) a lower surface having a lower profile that is identical to the upper profile; and (b) each adjustable float portion of the at least one adjustable float portion of the first and second stabilizer units includes:

(1) an upper surface having a first auxiliary profile, and (2) a lower surface having a second auxiliary profile that is identical to the upper profile of the main float portion.

7. The stabilizer as described in claim 5, wherein each strap of the first and second stabilizer units includes:

(a) a first orifice for receiving the distal end of the respective body therethrough, the first orifice being spaced such that the fastening means of the strap is located above the respective float as the strap secures the at least one adjustable float portion vertically above the main float portion; and (b) a second orifice for receiving the distal end of the respective body therethrough, the second orifice being spaced such that the fastening means of the strap is located above the respective float as the strap secures the at least one adjustable float portion vertically below the main float portion.

8. The stabilizer as described in claim 5 wherein each lock unit includes a threaded bore defined in a sleeve attached to the respective body and a threaded fastener threadably received in the threaded bore.

* * * * *